US007360922B1

(12) United States Patent
Yeh

(10) Patent No.: US 7,360,922 B1
(45) Date of Patent: Apr. 22, 2008

(54) COMBINATION OF LIGHT TUBE WITH STABILIZER

(75) Inventor: Jerry Yeh, Sweilin Shang (TW)

(73) Assignee: Weico (Asia) Industries Ltd., Yunlin Hsien (TW)

( * ) Notice: Subject to any disclaimer, the term of this patent is extended or adjusted under 35 U.S.C. 154(b) by 0 days.

(21) Appl. No.: 11/692,335

(22) Filed: Mar. 28, 2007

(51) Int. Cl.
*F21S 9/00* (2006.01)
*H01R 33/02* (2006.01)

(52) U.S. Cl. ..... 362/217; 362/652; 362/655; 362/260; 362/263; 439/226; 439/232; 439/356

(58) Field of Classification Search ..... None
See application file for complete search history.

(56) References Cited

U.S. PATENT DOCUMENTS 2,430,602 A * 11/1947 De Bell ..... 439/232
2,797,311 A * 6/1957 Jurick ..... 362/217
4,316,649 A * 2/1982 Alvarez et al. ..... 359/556
4,723,200 A * 2/1988 Troen ..... 362/260
5,088,015 A * 2/1992 Baggio et al. ..... 362/217
5,469,348 A * 11/1995 Wong ..... 362/217
6,457,846 B2 * 10/2002 Cook et al. ..... 362/321
6,552,493 B2 * 4/2003 Yen ..... 315/82
6,960,003 B2 * 11/2005 Takano ..... 362/645
7,090,373 B2 * 8/2006 Lai ..... 362/202
2007/0049123 A1 * 3/2007 Sibout ..... 439/666

* cited by examiner

*Primary Examiner*—Sandra O'Shea
*Assistant Examiner*—Danielle Dunn
(74) *Attorney, Agent, or Firm*—Mark A. Mersereau; Nikolai & Mersereau, P.A.

(57) ABSTRACT

A light tube assembly includes a light tube and a stabilizer which includes a tubular body with copper members that are slidably engaged with curved slots in a base. A core with terminal plates is received in the tubular body and two locking pin 51s extend through grooves in the tubular body and are removably inserted into the base. An end cap is rotatably connected to the core and is positioned at three positions. The three positions allow the user to replace the base, to replace the light tube and to secure the light tube respectively.

4 Claims, 5 Drawing Sheets

COMBINATION OF LIGHT TUBE WITH STABILIZER

FIELD OF THE INVENTION

The present invention relates to a connection between a light tube and a stabilizer by using locking pins to lock the stabilizer to the light tube.

BACKGROUND OF THE INVENTION

A conventional energy saving light tube generally includes a light tube and a stabilizer which is connected to one end of the light tube. The stabilizer is more durable than the light tube which has a limited term of life and needs to be replaced, and the stabilizer is much expensive than the light tube, so that the light tube and the stabilizer are made separately and a connection device is used to connected them. Therefore, the light tube can be replaced individually. In order to secure the connection between the light tube and the stabilizer, an extra locking device is developed to ensure the connection. This requires special design to the base of the stabilizer so as to be cooperated with the locking device and a high expense is expected.

The present invention intends to provide a connection device for connecting a light tube with a stabilizer and at least one locking pin is used to securely connect the stabilizer and the light tube. The connection device is cooperated with existed stabilizers of different brands by using a shorter locking pin.

SUMMARY OF THE INVENTION

The present invention relates to a light tube assembly that comprises a light tube having an insertion extending from an end thereof and two protrusions extend from two sides of the insertion. A stabilizer includes a tubular body in which a core is received. Two grooves are defined axially in the tubular body and two copper members of the tubular body are slidably engaged with curved slots in a base which is removably connected to an end of the tubular body. An end cap is rotatably connected to the other end of the tubular body and has two pawls so as to hook the core. An elongate through hole is defined through the end cap. The core has an elongate receiving hole defined therein which communicates with the elongate through hole of the end cap. A first recess and a second recess are defined in two facing insides of the receiving hole respectively. A positioning block protrudes from an inner periphery of the second recess. The insertion of the light tube extends through the elongate hole of the end cap and inserted into the receiving hole. The two protrusions on the insertion are stopped by the positioning block of the second notch. Two engaging recesses are defined in an outer periphery thereof and the two pawls of the end cap are engaged with the engaging recesses.

The base has two notches defined in a face thereof. Two locking pins inserted into the two grooves of the tubular body. Each locking pin has an inclined surface defined in a first end thereof and a tongue extends axially from a second end of each locking pin. The two respective tongues of the two locking pins are removably inserted into the notches of the base. Each locking pin is cooperated with a spring which biases the locking pin at a high position such that the inclined surface is in contact with the pawl corresponding thereto.

A positioning device is located between the end cap and the core to set the end cap at a first position, a second position and a third position relative to the core. In the first position, the two respective second ends of the locking pins are not inserted into the base and the through hole of the end cap is not in alignment with the first recess so that the insertion of the light tube cannot be inserted into the receiving hole of the core, and the base can be removed from the tubular body. In the second position, the two respective second ends of the locking pin 51s are inserted into the base and the through hole of the end cap is in alignment with the first recess so that the insertion of the light tube can be inserted into the receiving hole of the core. In the third position, the two respective second ends of the locking pin 51s are inserted into the base and the insertion of the light tube is rotated with the end cap and the protrusions are stopped by the positioning block so that the light tube is secured to the core.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
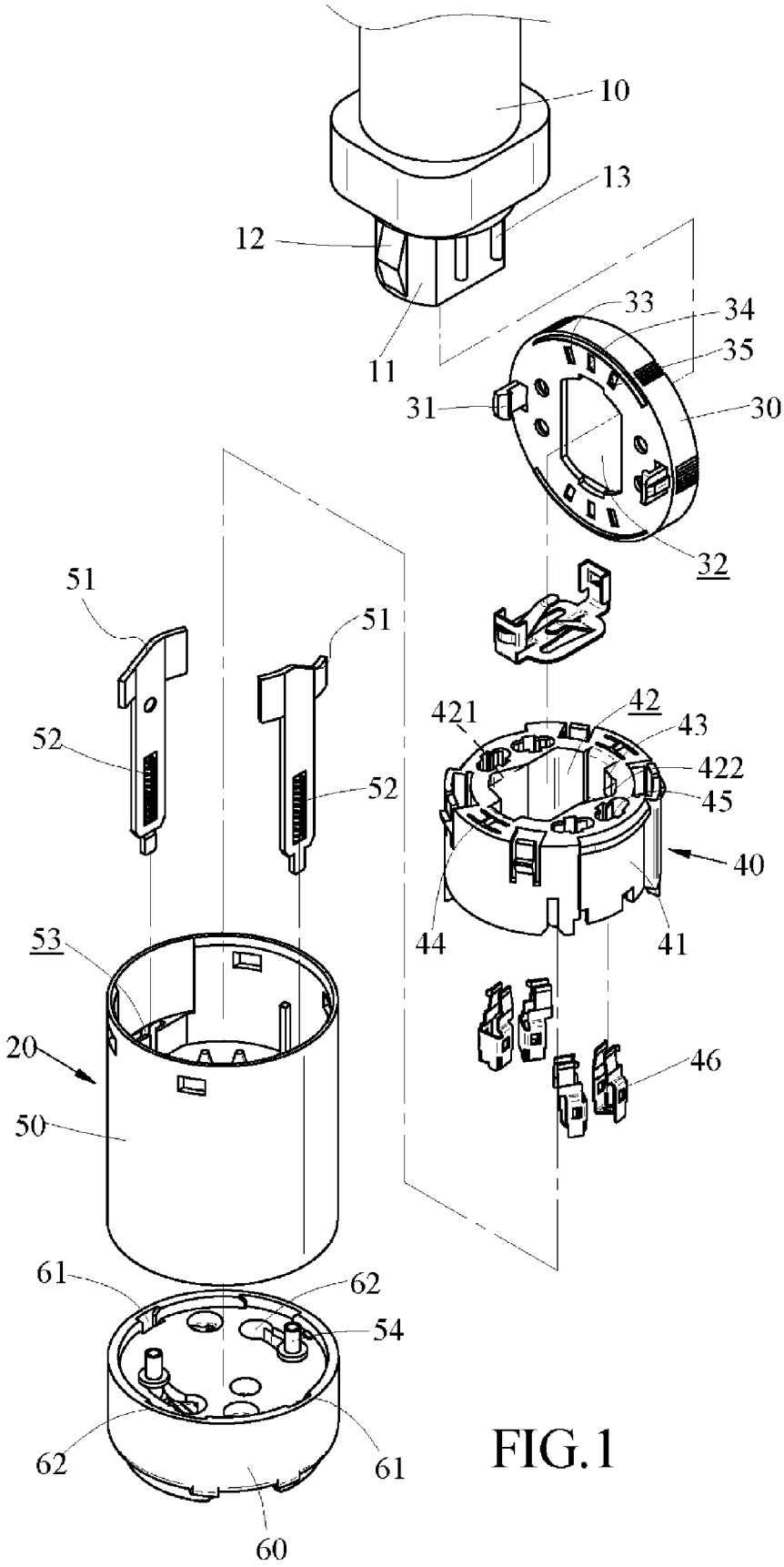
FIG. 1 is an exploded view to show the light tube assembly of the present invention.

Referring to FIG. 1, the light tube assembly of the present invention comprises a light tube 10 which has an insertion 11 extending from an end thereof and two protrusions 12 extend from two sides of the insertion 11. Two conductive members 13 are connected to a surface of the insertion 11.

A stabilizer 20 includes a tubular body 50 and two grooves 53 are defined axially in the tubular body 50. A core 40 is received in the tubular body 50 and an end cap 30 is rotatably connected to a first end of the core 40 and located at a first end of the tubular body 50. Two pawls 31 extend from an underside of the end cap 30 and an elongate through hole 32 is defined through the end cap 30.

The core 40 has an elongate receiving hole 42 defined therein which communicates with the elongate through hole 32 of the end cap 30. A first recess 421 and a second recess 422 are defined in two facing insides of the receiving hole 42 respectively, and a positioning block 43 protrudes from an inner periphery of the second recess 422. The insertion 11 of the light tube 10 is allowed to extend through the elongate hole 32 of the end cap 30 and inserted into the receiving hole 42 when the end cap 30 is rotated to a correct position which will be described later. The two protrusions 12 on the insertion 11 are then stopped by the positioning block 43 of the second notch 422 to position the light tube 10 to the core 40. Two engaging recesses 41 are defined in an outer periphery thereof and the two pawls 31 of the end cap 30 are engaged with the engaging recesses 41.

A positioning device located between the end cap 30 and the core 40 to set the end cap 30 at a first position, a second position and a third position relative to the core 40. The positioning device includes a first notch 33, a second notch 34 and a third notch 35 defined in the underside of the end cap 30, and a rib 44 extends from the first end of the core 40. The rib 44 is engaged with one of the first, second and third notches 33, 34, so as to position the end cap 30 at the three positions.

A base 60 is connected to a second end of the tubular body 20 and has two curved slots 62 defined in a surface thereof. Two copper members 54 on the tubular body 50 are slidably engaged with the two curved slots 62. Two notches 61 are defined in a face of the base 60.

Two locking pin 51s are inserted into the two grooves 53 of the tubular body 50 and each locking pin 51 has an inclined surface defined in a first end thereof and a tongue extends axially from a second end of each locking pin 51. The two respective tongues of the two locking pin 51s are removably inserted into the notches 61 of the base 60. Each locking pin 51 cooperated with a spring 52 which biases the locking pin 51 at a high position such that the inclined surface is in contact with the pawl 31 corresponding thereto.

Figure 3:
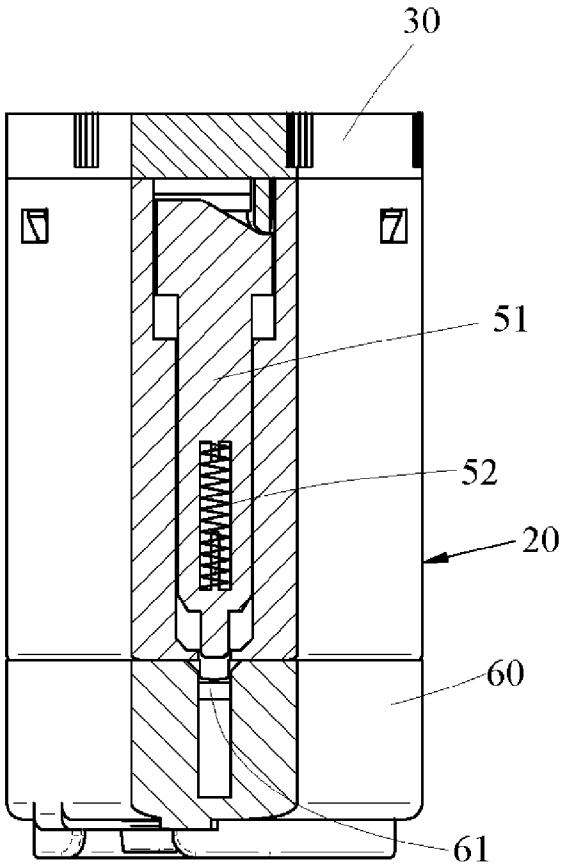
FIG. 3 is a cross sectional view to show that the locking pin 51 is not yet moved toward the base.
Figure 2:
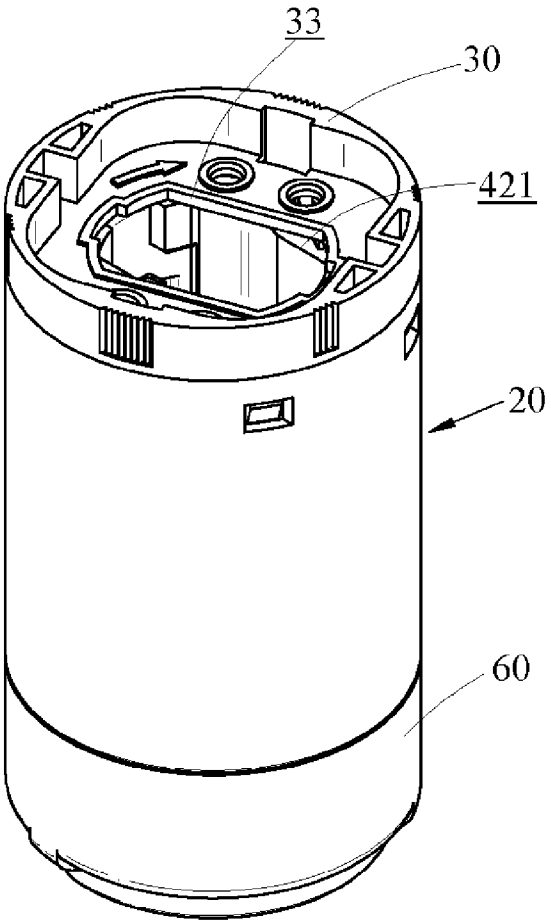
FIG. 2 is a perspective view to show the light tube assembly of the present invention wherein the end cap is in the first position.

As shown in FIGS. 2 and 3, when the end cap 30 is in the first position, each of the pawls 31 is located at the lowest position of the inclined surface of the locking pin 51 so that the two respective second ends of the locking pin 51s are not inserted into the base 60. The through hole 32 of the end cap 30 is not in alignment with the first recess 421 so that the insertion 11 of the light tube 10 cannot be inserted into the receiving hole 42 of the core 40 and the base 60 can be removed from the tubular body 50.

Figure 5:
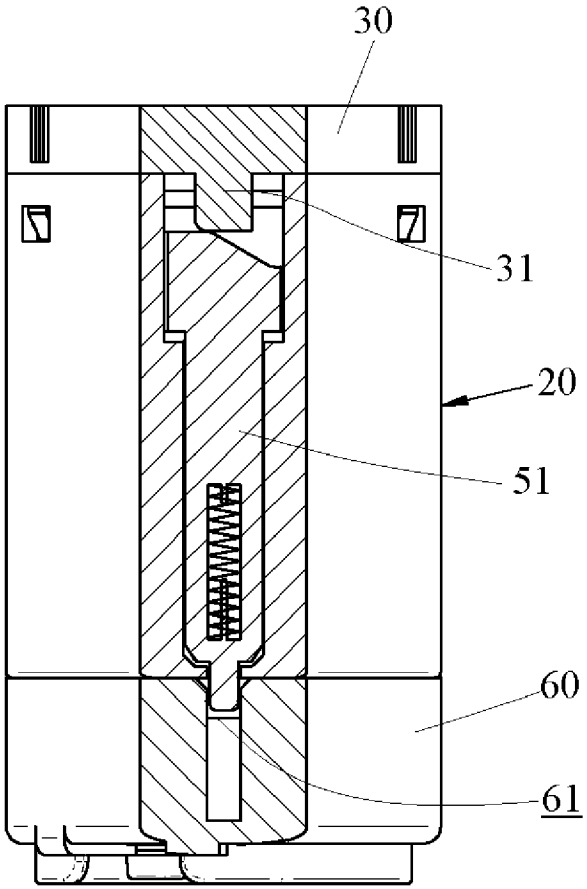
FIG. 5 is a cross sectional view to show that the tongue of the locking pin 51 is inserted into the notch in the base.
Figure 4:
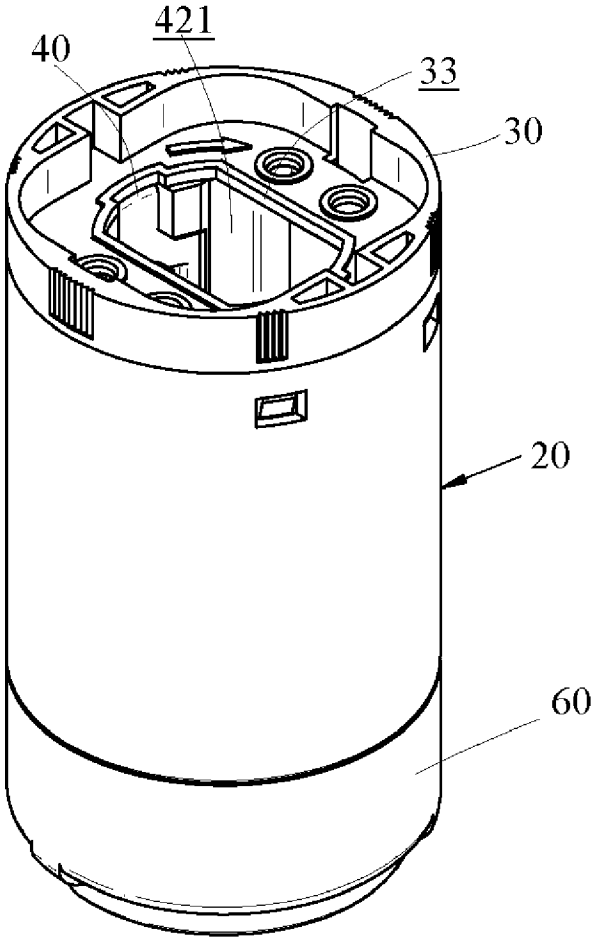
FIG. 4 is a perspective view to show the light tube assembly of the present invention wherein the end cap is in the second position.

FIGS. 4 and 5 show that when the end cap 30 is in the second position, the two respective second ends of the locking pins 51 are inserted into the base 60 and the through hole 32 of the end cap 30 being in alignment with the first recess 421 so that the insertion 11 of the light tube 10 can be inserted into the receiving hole 42 of the core 40.

Figure 7:
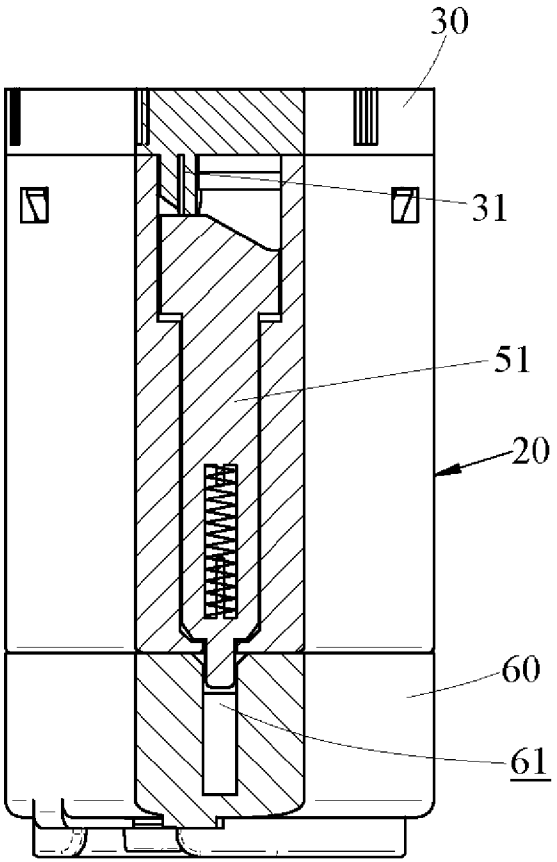
FIG. 7 is a cross sectional view to show that the tongue of the locking pin 51 is pushed by the pawl of the end cap and inserted into the notch in the base.
Figure 6:
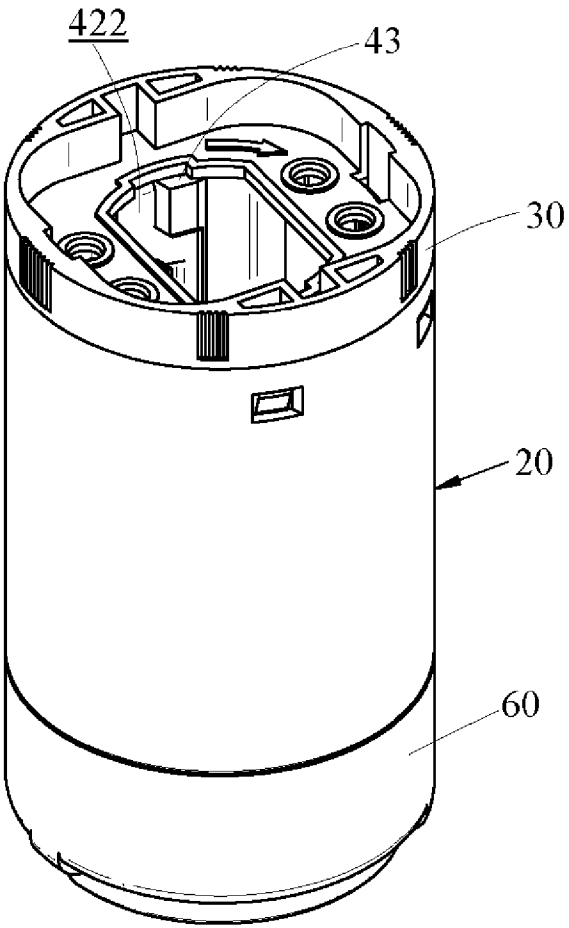
FIG. 6 is a perspective view to show the light tube assembly of the present invention wherein the end cap is in the third position.

FIGS. 6 and 7 show that when the end cap 30 is in the third position, the two pawls 31 are moved upward along the inclined surface of the locking pin 51 so that the two respective second ends of the locking pins 51 are inserted into the base 60 and the insertion 11 of the light tube 10 is rotated with the end cap 30 so that the protrusions 12 are stopped by the positioning block 43 and the light tube 10 is secured to the core 40.

Figure 8:
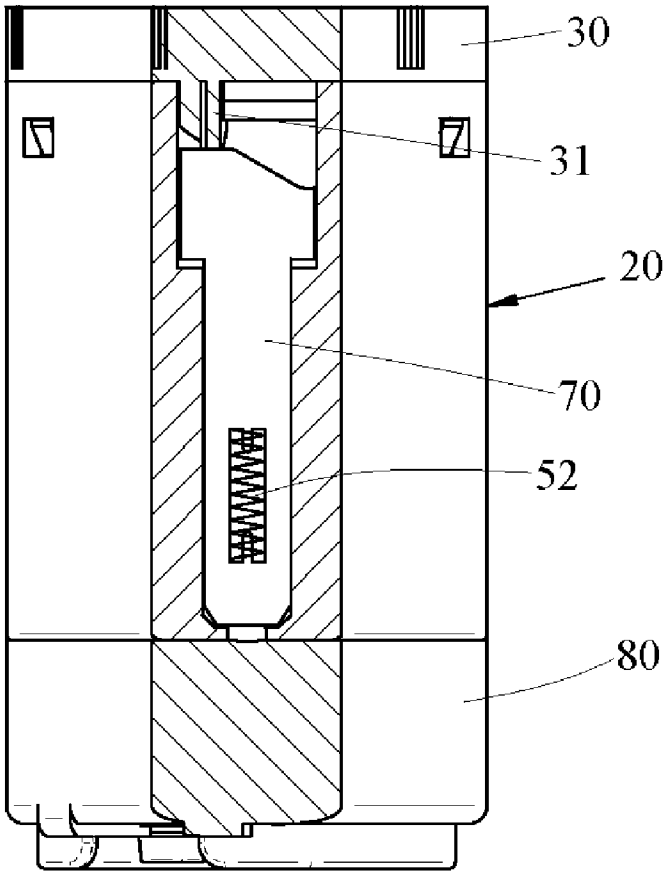
FIG. 8 is a cross sectional view to show that the light tube assembly is cooperated with another base.

FIG. 8 shows that the light tube assembly is cooperated with another base 80 by using shorter locking pins 70, wherein the base 80 does not have the notches 61 as disclosed in FIG. 1 and each of the shorter locking pins 70 does not have the tongue on the second end thereof. Therefore, the locking pins 70 do not push the base 80 whichever position the end cap 30 is set.

While we have shown and described the embodiment in accordance with the present invention, it should be clear to those skilled in the art that further embodiments may be made without departing from the scope of the present invention.

What is claimed is:

1. A light tube assembly comprising:

a light tube having an insertion extending from an end thereof and two protrusions extending from two sides of the insertion, two conductive members connected to a surface of the insertion;

a stabilizer having a tubular body and two grooves defined axially in the tubular body;

an end cap rotatably located on a first end of the tubular body and having two pawls extending from an underside thereof, an elongate through hole defined through the end cap;

a core received in the tubular body and having an elongate receiving hole defined therein which communicates with the elongate through hole of the end cap, a first recess and a second recess defined in two facing insides of the receiving hole respectively, a positioning block protruding from an inner periphery of the second recess, the insertion of the light tube extending through the elongate hole of the end cap and inserted into the receiving hole, the two protrusions on the insertion being stopped by the positioning block of the second notch, two engaging recesses defined in an outer periphery thereof and the two pawls of the end cap engaged with the engaging recesses so that the end cap is connected to a first end of the core;

a base connected to a second end of the tubular body and having two curved slots defined in a surface thereof, two copper members on the tubular body being slidably engaged with the two curved slots, two notches defined in a face of the base;

two locking pins inserted into the two grooves of the tubular body, each locking pin having an inclined surface defined in a first end thereof and a tongue extending axially from a second end of each locking pin the two respective tongues of the two locking pins removably inserted into the notches of the base, each locking pin cooperated with a spring which biases the locking pin at a high position such that the inclined surface is in contact with the pawl corresponding thereto, and a positioning device located between the end cap and the core to set the end cap at a first position, a second position and a third position relative to the core, in the first position, the two respective second ends of the locking pins being not inserted into the base and the through hole of the end cap being not in the first recess so that the insertion of the light tube cannot be inserted into the receiving hole of the core and the base can be removed from the tubular body, in the second position, the two respective second ends of the locking pins being inserted into the base and the through hole of the end cap being in alignment with the first recess so that the insertion of the light tube can be inserted into the receiving hole of the core, in the third position, the two respective second ends of the locking pins being inserted into the base and the insertion of the light tube being rotated with the end cap and the protrusions being stopped by the positioning block so that the light tube is secured to the core.

2. The light tube assembly as claimed in claim 1, wherein the end cap has a first notch, a second notch and a third notch defined in the underside thereof, the core has a rib extends from the first end thereof, the rib is engaged with one of the first, second and third notches so as to position the end cap at the three positions.

3. The light tube assembly as claimed in claim 1, wherein the core includes terminal recesses defined in a second end thereof and terminal plates are received in each of the terminal recesses so as to be in contact with the conductive members of the light tube when the end cap is set at the third position.

4. A light tube assembly comprising:

a light tube having an insertion extending from an end thereof and two protrusions extending from two sides of the insertion, two conductive members connected to a surface of the insertion;

a stabilizer having a tubular body and two grooves defined axially in the tubular body;

an end cap rotatably located at a first end of the tubular body and having two pawls extending from an underside thereof, an elongate through hole defined through the end cap;

a core received in the tubular body and having an elongate receiving hole defined therein which communicates with the elongate through hole of the end cap, a first recess and a second recess defined in two facing insides of the receiving hole respectively, a positioning block protruding from an inner periphery of the second recess, the insertion of the light tube extending through the elongate hole of the end cap and inserted into the receiving hole, the two protrusions on the insertion being stopped by the positioning block of the second notch, two engaging recesses defined in an outer periphery thereof and the two pawls of the end cap engaged with the engaging recesses so that the end cap is connected to a first end of the core;

a base connected to a second end of the tubular body and having two curved slots defined in a surface thereof, two copper members on the tubular body being slidably engaged with the two curved slots;

two locking pins inserted into the two grooves of the tubular body, each locking pin having an inclined surface defined in a first end thereof, each locking pin cooperated with a spring which biases the locking pin at a high position such that the inclined surface is in contact with the pawl corresponding thereto, and a positioning device located between the end cap and the core to set the end cap at a first position, a second position and a third position relative to the core, in the first position, the two respective second ends of the locking pins being not inserted into the base and the through hole of the end cap being not in the first recess so that the insertion of the light tube cannot be inserted into the receiving hole of the core and the base can be removed from the tubular body, in the second position, two respective second ends of the locking pins being not inserted into the base and the through hole of the end cap being in the first recess so that the insertion of the light tube can be inserted into the receiving hole of the core, in the third position, the two respective second ends of the locking pins being not inserted into the base and the insertion of the light tube being rotated with the end cap and the protrusions being stopped by the positioning block so that the light tube is secured to the core.

* * * * *